US009332824B2

(12) United States Patent
Kriemelmeyer

(10) Patent No.: US 9,332,824 B2
(45) Date of Patent: May 10, 2016

(54) BACKPACK ASSEMBLY

(71) Applicant: Matilda A. Kriemelmeyer, Spring Grove, MN (US)

(72) Inventor: Matilda A. Kriemelmeyer, Spring Grove, MN (US)

( * ) Notice: Subject to any disclaimer, the term of this patent is extended or adjusted under 35 U.S.C. 154(b) by 93 days.

(21) Appl. No.: 14/267,466

(22) Filed: May 1, 2014

(65) Prior Publication Data

US 2015/0313348 A1 Nov. 5, 2015

(51) Int. Cl.

| | |
|---|---|
| ***A45F 3/04*** | (2006.01) |
| ***A45F 4/02*** | (2006.01) |
| ***A47B 3/10*** | (2006.01) |
| ***A47C 13/00*** | (2006.01) |
| ***A47B 3/14*** | (2006.01) |

(52) U.S. Cl.

CPC ... *A45F 4/02* (2013.01); *A45F 3/04* (2013.01); *A47B 3/10* (2013.01); *A47B 3/14* (2013.01); *A47C 13/00* (2013.01); *A45F 2004/026* (2013.01)

(58) Field of Classification Search

CPC ..... A45F 4/02; A45F 3/04; A45B 3/10; A45B 3/14

See application file for complete search history.

(56) References Cited

U.S. PATENT DOCUMENTS

| | | | | |
|---|---|---|---|---|
| 3,690,525 | A * | 9/1972 | Koons | B60N 2/286 224/155 |
| 4,392,598 | A | 7/1983 | Dixon | |
| 4,582,165 | A * | 4/1986 | Latini | A01M 31/02 108/152 |
| D284,910 | S | 8/1986 | Handy | |
| 4,955,517 | A * | 9/1990 | Maresca | A45F 4/02 224/155 |
| 5,016,792 | A | 5/1991 | Jay | |
| 5,156,310 | A * | 10/1992 | Biedenharn, Jr. | A45F 4/02 224/155 |
| 5,297,708 | A * | 3/1994 | Carpenter | A45F 4/02 224/155 |
| 5,307,527 | A * | 5/1994 | Schober | E04H 4/14 297/254 |
| 5,409,291 | A * | 4/1995 | Lamb | A01K 97/10 224/155 |
| 5,628,437 | A * | 5/1997 | Kober | A01M 31/02 182/187 |
| 6,062,446 | A * | 5/2000 | Daneau | A45F 4/06 135/95 |
| 6,145,716 | A | 11/2000 | Caicedo | |
| 6,843,527 | B2 | 1/2005 | Nelson et al. | |
| 7,052,080 | B2 * | 5/2006 | Knight | A45F 4/02 224/155 |
| 7,150,465 | B2 | 12/2006 | Darling, III | |
| 7,775,587 | B1 * | 8/2010 | Reed | A47C 4/52 297/129 |
| 2006/0261103 | A1 | 11/2006 | Strange | |
| 2012/0067930 | A1 * | 3/2012 | Talavera Tolentino | A45F 4/02 224/155 |

* cited by examiner

*Primary Examiner* — Brian D Nash

(57) ABSTRACT

A backpack assembly for converting into a table and chairs includes a primary frame that is selectively positionable between a table position and a box position. A movable portion of the primary frame is operationally coupled to a central portion of the primary frame. A secondary frame is operationally coupled to the primary frame. The secondary frame is selectively used as a chair. A leg is selectively coupled to the primary frame. The primary frame is supported above a support surface when the primary frame is selectively positioned into the table position. A carrying frame is operationally coupled to the primary frame. The carrying frame is selectively coupled to a user so the user carries the assembly. A wheel selectively coupled to the carrying frame The assembly is selectively rolled along the support surface.

18 Claims, 7 Drawing Sheets

BACKPACK ASSEMBLY

BACKGROUND OF THE DISCLOSURE

Field of the Disclosure

The disclosure relates to backpack devices and more particularly pertains to a new backpack device for converting into a table and chairs.

SUMMARY OF THE DISCLOSURE

An embodiment of the disclosure meets the needs presented above by generally comprising a primary frame that is selectively positionable between a table position and a box position. A movable portion of the primary frame is operationally coupled to a central portion of the primary frame. A secondary frame is operationally coupled to the primary frame. The secondary frame is selectively used as a chair. A leg is selectively coupled to the primary frame. The primary frame is supported above a support surface when the primary frame is selectively positioned into the table position. A carrying frame is operationally coupled to the primary frame. The carrying frame is selectively coupled to a user so the user carries the assembly. A wheel selectively coupled to the carrying frame The assembly is selectively rolled along the support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
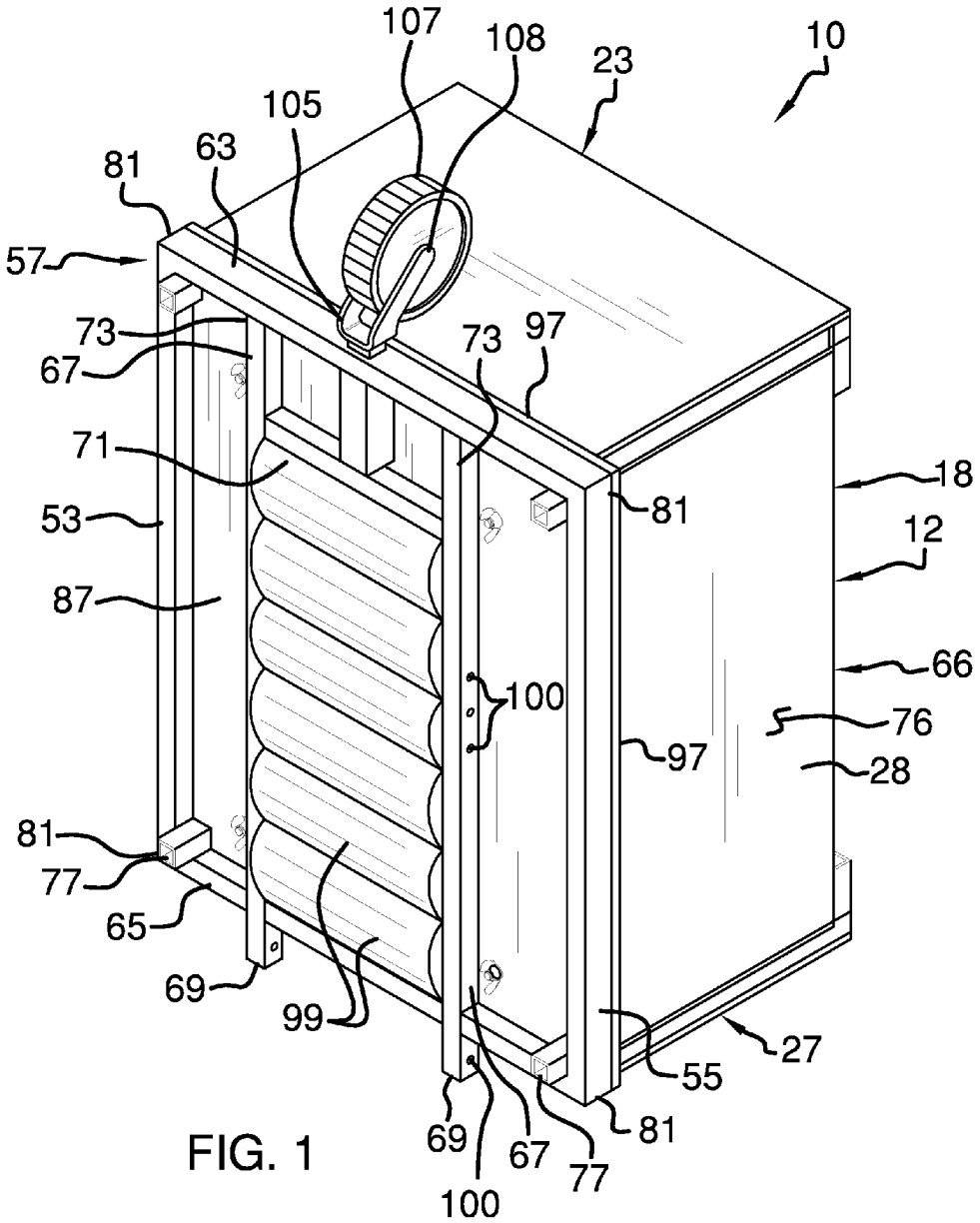
FIG. 1 is a front perspective view of a backpack assembly according to an embodiment of the disclosure.
Figure 2:
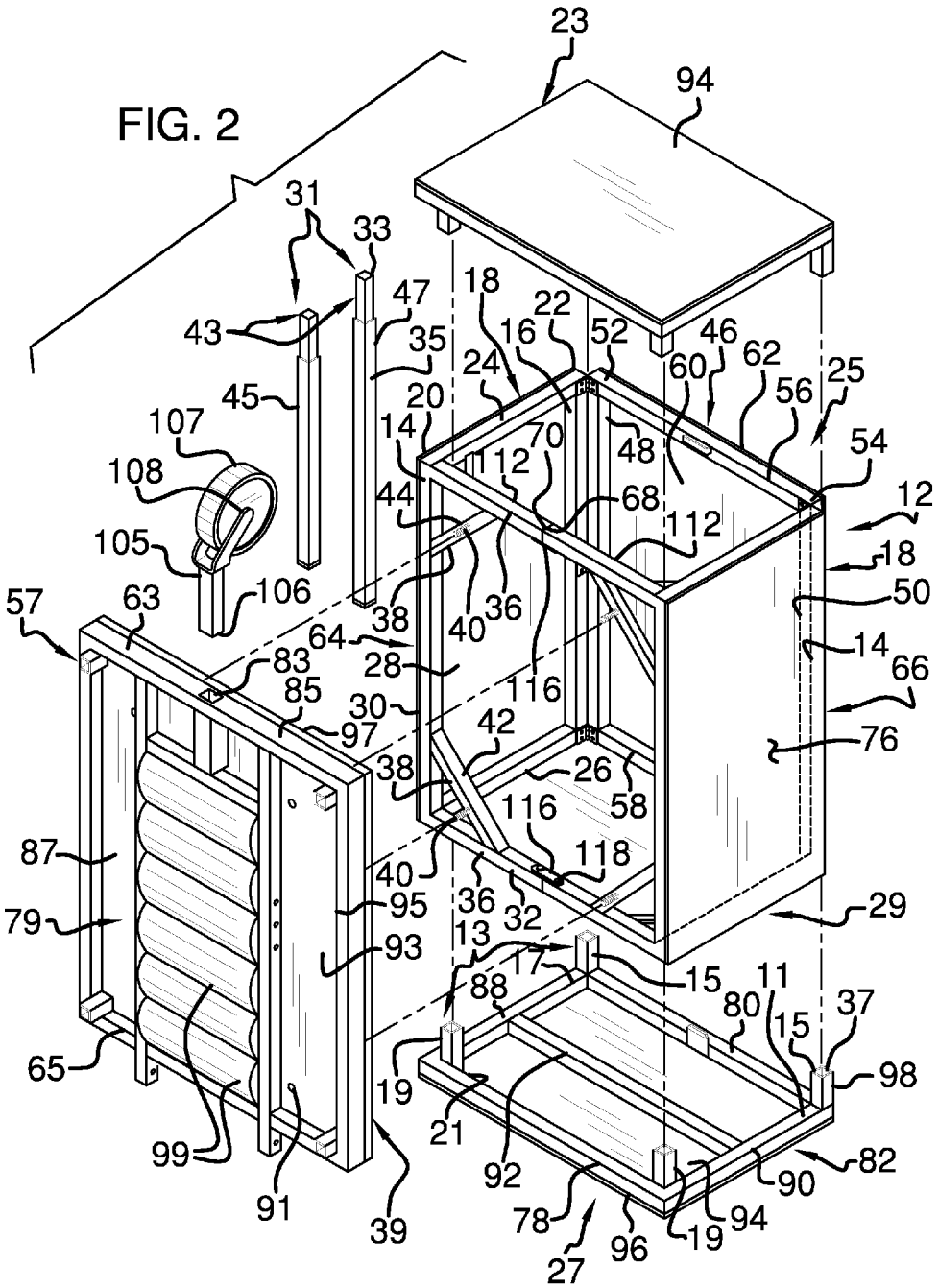
FIG. 2 is a top perspective view of an embodiment of the disclosure.
Figure 3:
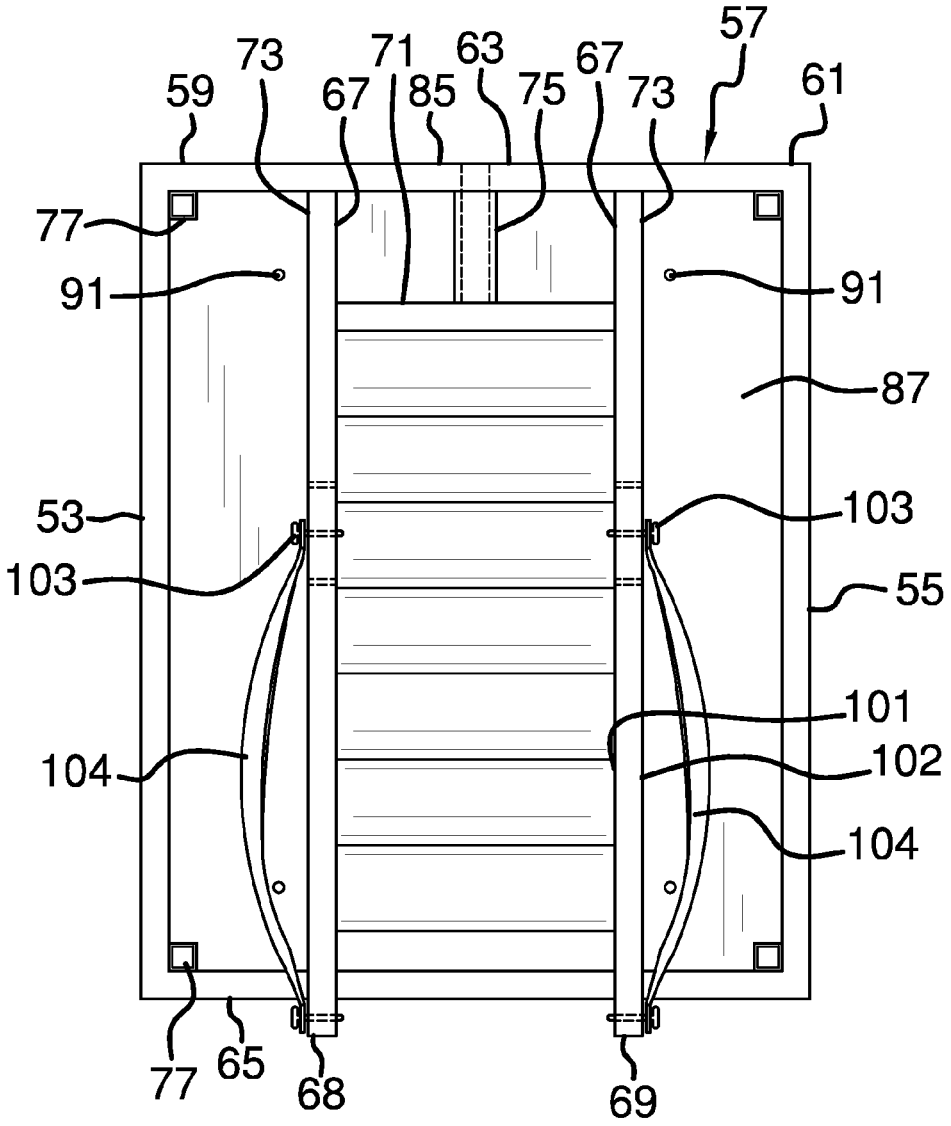
FIG. 3 is a front view of an embodiment of the disclosure.
Figure 4:
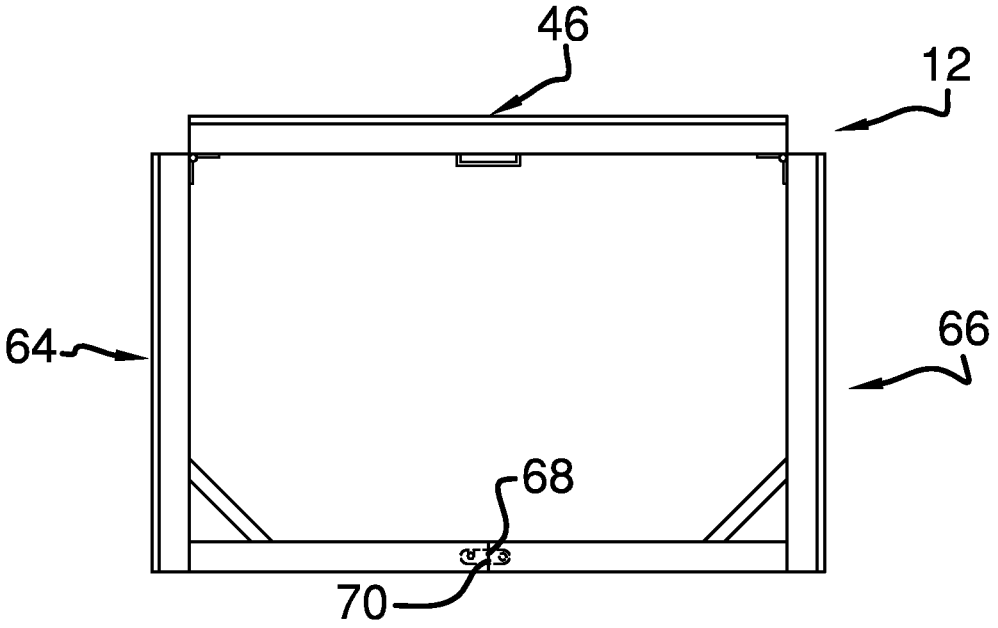
FIG. 4 is a top view of an embodiment of the disclosure.
Figure 5:
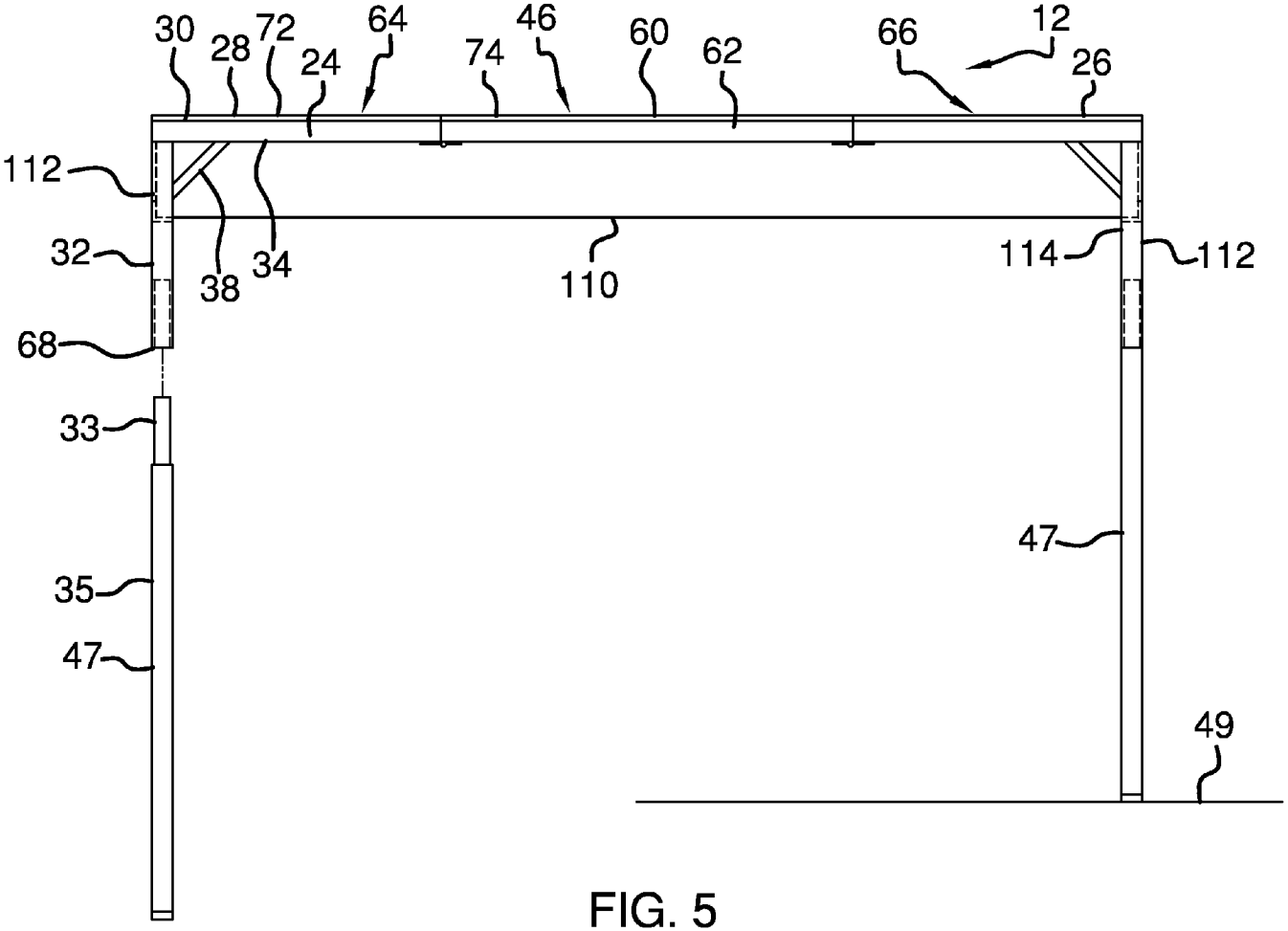
FIG. 5 is a back view of a primary frame an embodiment of the disclosure in an opened table position.
Figure 6:
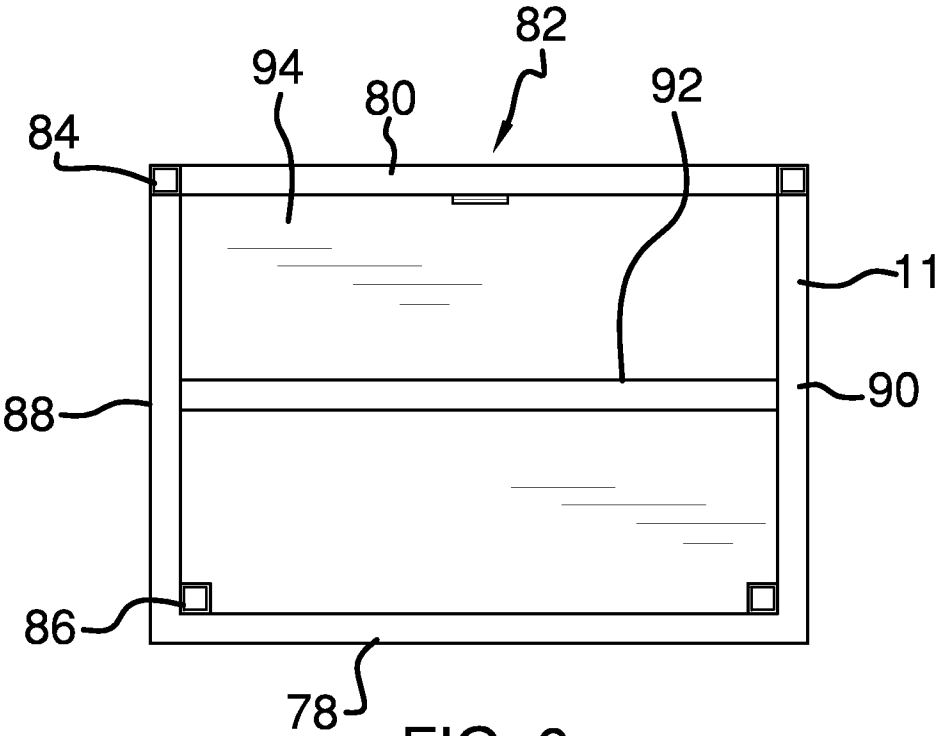
FIG. 6 is a bottom view of an embodiment of the disclosure.
Figure 7:
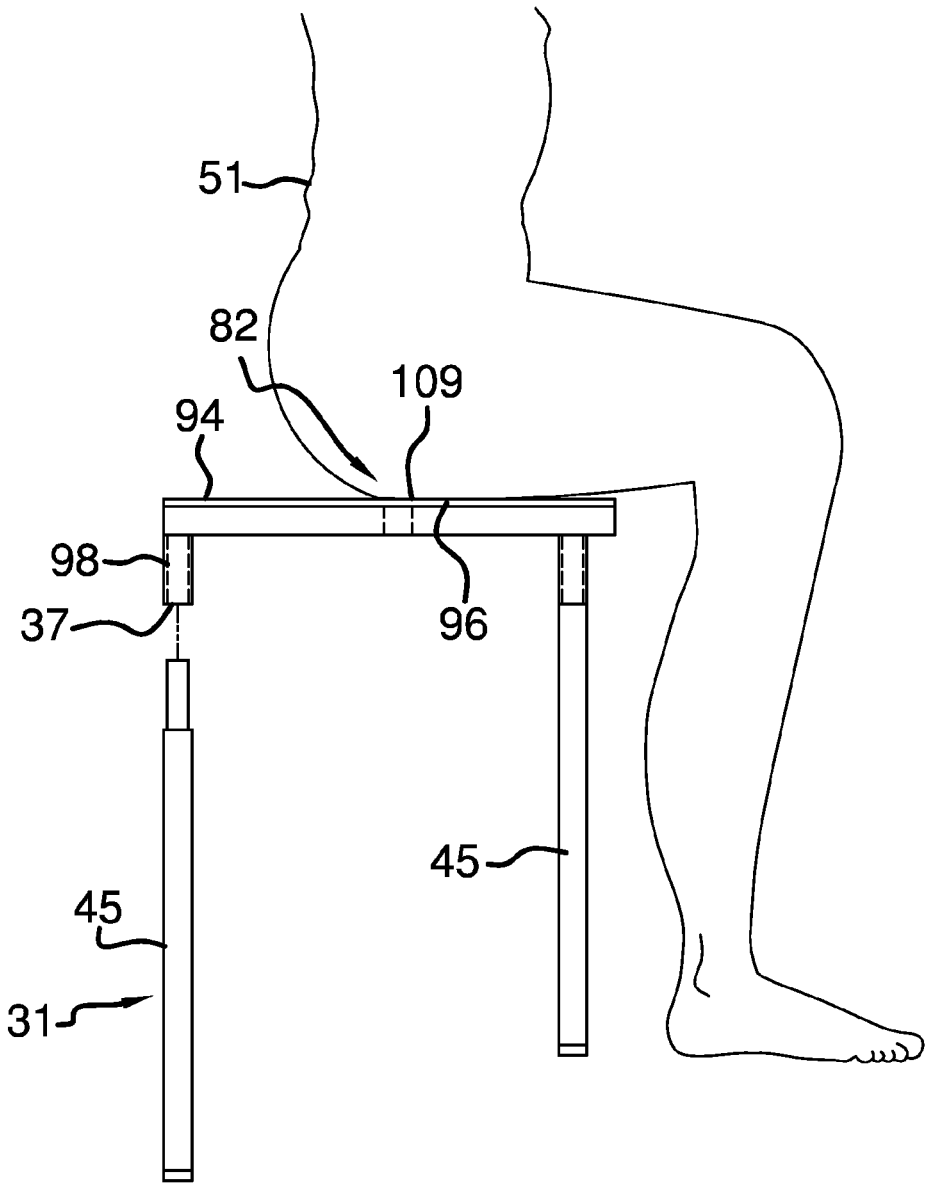
FIG. 7 is a right side view of an end piece of an embodiment of the disclosure in a chair set up position.

With reference now to the drawings, and in particular to FIGS. 1 through 7 thereof, a new backpack device embodying the principles and concepts of an embodiment of the disclosure and generally designated by the reference numeral 10 will be described.

As best illustrated in FIGS. 1 through 7, the backpack assembly 10 generally comprises a primary frame 12. An exterior arm 14 and an interior arm 16 of a movable portion 18 of the primary frame 12 is each coupled between an associated first end 20 and second end 22 of each of a top arm 24 and a bottom arm 26 of the movable portion 18 of the primary frame 12. Moreover, the movable portion 18 of the primary frame 12 has a rectangular shape that may have a width between 30 cm and 45 cm and a length between 45 cm and 65 cm. A panel 28 is coupled to a top side 30 of the movable portion 18 of the primary frame 12. The panel 28 completely covers the top side 30 of the movable portion 18 of the primary frame 12.

A leg support 32 is coupled to and extends away from a bottom side 34 of the movable portion 18 of the primary frame 12. The leg support 32 is one of a pair of the leg supports 36. Each of the pair of leg supports 36 is positioned proximate an associated intersection of the exterior arm 14 of the movable portion 18 of the primary frame 12 and the top 24 and bottom 26 arms of the movable portion 18 of the primary frame 12. Further, each of the leg supports 32 may have a length between 25 cm and 30 cm.

A brace 38 extends between the leg support 32 on the movable portion 18 of the primary frame 12 and the exterior arm 14 of the movable portion 18 of the primary frame 12. Continuing, a stud 40 is coupled to and extends laterally away from the brace 38 proximate a center of the brace 38. The stud 40 may have a length between 1.5 cm and 4 cm. The brace 38 is one of a pair of the braces 38. Each of the pair of braces 38 extends between an associated one of a first one 42 and a second one 44 of the pair of leg supports and the exterior arm 14 of the movable portion 18 of the primary frame 12.

A central portion 46 of the primary frame 12 comprises a first lateral arm 48 and a second lateral arm 50 of the central portion 46 of the primary frame 12. Each of the first 48 and second 50 lateral arms of the central portion 46 of the primary frame 12 is coupled between an associated one of a first end 52 and a second end 54 of each of a top arm 56 and a bottom arm 58 of the central portion 46 of the primary frame 12. Continuing, the central portion 46 of the primary frame 12 has a rectangular shape that may have a width between 30 cm and 45 cm and a length between 45 cm and 65 cm. A panel 60 is coupled to a top side 62 of the central portion 46 of the primary frame 12. The panel 60 completely covers the top side 62 of the central portion 46 of the primary frame 12.

The movable portion 18 of the primary frame 12 is one of a pair of movable portions of the primary frame 12. The exterior arm 14 of a first one of the pair of movable portions 64 of the primary frame 12 is coextensively and hingedly coupled to the first lateral arm 48 of the central portion 46 of the primary frame 12. Continuing, the exterior arm 14 of a second one of the pair of movable portions 66 of the primary frame 12 is coextensively and hingedly coupled to the second lateral arm 50 of the central portion 46 of the primary frame 12. Each of the first 64 and second 66 movable portions of the primary frame 12 has a width that is equal to a width of the central portion 46 of the primary frame 12.

Each of the first 64 and second 66 movable portions of the primary frame 12 are positionable in a stored position. Moreover, each of the first 64 and second 66 movable portions of the primary frame 12 extends away from the central portion 46 of the primary frame 12 at a right angle. A bottom end 68 of the pair of leg supports 36 on the first movable portion 64 of the primary frame 12 abuts a bottom end 70 of an associated one of the pair of leg supports 36 on the second movable portion 66 of the primary frame 12. The primary frame 12 forms a rectangular parallelepiped shape so the primary frame 12 may contain objects. The objects may be objects related to camping or picnicking.

A pair of locks 116 is movably coupled to an associated one of each of the pair of leg supports 36 of the first movable portion 64 of the primary frame 12. A pair of pins 118 is coupled to an associated one of each of the pair of leg supports on the second movable portion 66 of the primary frame 12. The pair of locks 116 each selectively engages the associated one of the pair of pins 118 when the first 64 and second 66 movable portions of the primary frame 12 are positioned in the stored position. Lastly, the pair of locks 116 retains the first 64 and second 66 movable portions of the primary frame 12 in the stored position.

The first 64 and second 66 movable portions of the primary frame 12 are each positionable in an extended position. Continuing, each of the first 64 and second 66 movable portions of the primary frame 12 extends laterally away from the central portion 46 of the primary frame 12. A top surface 72 of the panel 28 on the first movable portion 64 of the primary frame 12 lies on a plane being co-planar with a top surface 74 of the panel 60 on the central portion 46 of the primary frame 12. Additionally, a top surface 76 of the panel 28 on the second movable portion 66 of the primary frame 12 lies on a plane being co-planar with the top surface 74 of the panel 60 on the central portion 46 of the primary frame 12. Lastly, the primary frame 12 forms a table.

A wire 110 is coupled between each of a front set 112 of the pair of leg supports 36 on the first 64 and second 66 movable portions of the primary frame 12. The wire is positioned proximate a middle 114 of each of the front set of leg supports 112. Moreover, the wire 110 is stretched tightly between each of the front set of leg supports 112 when the first 64 and second 66 movable portions are positioned in the extended position. The wire 110 provides stability to the first 64 and second 66 movable portions of the frame in the extended position.

A first lateral arm 78 and a second lateral arm 80 of a secondary frame 82 are each coupled between an associated one of a first end 84 and a second end 86 of each of a top arm 88 and a bottom arm 90 of the secondary frame 82. The secondary frame 82 has a rectangular shape that may have a length between 30 cm and 45 cm and a width between 45 cm and 65 cm. A central arm 92 of the secondary frame 82 is coupled between the top 88 and bottom 90 arms of the secondary frame 82. Continuing, a panel 94 is coupled to a top side 96 of the secondary frame 82 so the panel 94 completely covers the top side 96 of the secondary frame 82.

A leg support 98 is coupled to a bottom side 11 of the secondary frame 82. The leg support 98 may have a length between 5 cm and 10 cm. Additionally, the leg support 98 is one of a plurality of leg supports 98. The plurality of leg supports 98 comprises a pair of sets of leg supports 13. A first one of the pair of sets of the leg supports 15 is each coupled to a bottom side 17 of an intersection of the first lateral arm 78 of the secondary frame 82 and an associated one of the top 88 and bottom arms 90 of the secondary frame 82. Lastly, a second one of the pair of sets of the leg supports 19 is each coupled to an inner side 21 of an intersection of the second lateral arm 80 of the secondary frame 82 and an associated one of the top 88 and bottom arms 90 of the secondary frame 82.

The secondary frame 82 is one of a pair of the secondary frames 82. A first one of the pair of secondary frames 23 is removably coupled to a top end 25 of the primary frame 12 when the first 64 and second 66 movable portions of the primary frame 12 are positioned in a stored position. The first secondary frame 23 completely covers the top end 25 of the primary frame 12. A second one of the pair of secondary frames 27 is removably coupled to a bottom end 29 of the primary frame 12 when the first 64 and second 66 movable portions of the primary frame 12 are positioned in the stored position. The second secondary frame 27 completely covers the bottom end 29 of the primary frame 12. Continuing, each of the first pair of legs supports 15 on each of the first 23 and second 27 secondary frames is positioned outside of the primary frame 12 when the first 23 and second 27 secondary frames are coupled to the primary frame 12. Lastly, each of the pair of second leg supports 19 on each of the first 23 and second 27 secondary frames is positioned inside of the primary frame 12 with the first 23 and second 27 secondary frames are coupled to the primary frame 12.

A leg 31 is selectively coupled to the primary frame 12. A top portion 33 of the leg 31 has a width and a depth that is less than a width and a depth of a bottom portion 35 of the leg 31. The top portion 33 of the leg 31 is selectively insertable into an open bottom end 37 of the leg support 98 on the secondary frame 82. The leg 31 may have a rectangular cross section taken along a longitudinal axis extending through a top end 39 and a bottom end 41 of the leg 31.

The leg 31 is one of a plurality of the legs 31. The plurality of legs 31 comprises a pair of sets of the plurality of legs 43. Each of a first one of the pair of sets of the plurality of legs 45 has a length less than a length of each of a second one of the pair of sets of the plurality of legs 47. Further, each of the first set of legs 45 may have a length between 45 cm and 60 cm. The second set of legs 47 may have a length between 70 cm and 90 cm. Lastly, each of the first 45 and second 47 sets of legs are stored in the primary frame 12 when the first 64 and second 66 movable portions of the primary frame 12 are positioned in the stored position.

The top portion 33 of each of the first set of legs 45 is selectively inserted into the plurality of leg supports 32 on the movable portion 18 of the primary frame 12 when the first 64 and second 66 movable portions of the primary frame 12 are positioned in the deployed position. Further, the first set of legs 45 supports the primary frame 12 above a support surface 49 so the primary frame 12 may be used as a table. The top portion 33 of each of the second set of legs 47 is selectively inserted into the plurality of leg supports 98 on each of the first 23 and second 27 secondary frames. Further, the first 23 and second 27 secondary frames are supported above the support surface 49 so the first 23 and second 27 secondary frames may support a user 51.

A first lateral arm 53 and a second lateral arm 55 of a carrying frame 57 are each coupled between an associated one of a first end 59 and a second end 61 of each of a top 63 and bottom 65 arm of the carrying frame 57. The carrying frame 57 has a rectangular shape that may have a length between 50 cm and 80 cm and a width between 45 cm and 65 cm. A pair of spaced medial arms 67 of the carrying frame 57 is coupled between the top 63 and bottom 65 arms of the carrying frame 57. Additionally, a bottom end 69 of each of the pair of spaced medial arms 67 extends beyond the bottom arm 65 of the carrying frame 57. A medial lateral arm 71 of the carrying frame 57 is coupled between the pair of spaced medial arms 67 of the carrying frame 57 proximate a top end 73 of each of the pair of spaced medial arms 67 of the carrying frame 57.

A wheel arm 75 is coupled between the top arm 63 of the carrying frame 57 and the medial lateral arm 71 of the carrying frame 57. The wheel arm 75 is positioned proximate a middle of the top arm 63 of the carrying frame 57. A plurality of leg supports 77 is coupled to a front side 79 of the carrying frame 57. Each of the plurality of leg supports 77 is positioned proximate an associated one of four corners 81 of the carrying frame 57. Continuing, a wheel aperture 83 extends through a top side 85 of the top arm 63 of the carrying frame 57 so the wheel aperture 83 is aligned with an interior of the wheel arm 75.

A panel 87 is coupled to a back side 89 of the carrying frame 57 so the panel 87 completely covers the back side 89 of the carrying frame 57. Additionally, a stud aperture 91 extends through a front side 93 and a back side 95 of the panel 87 on the carrying frame 57. The stud aperture 91 may have a diameter between 3 mm and 8 mm. Further, the stud aperture 91 is one of a plurality of the stud apertures 91 each positioned proximate an associated one of the four corners 81 of the carrying frame 57. Each of the plurality of stud apertures 91 insertably receives an associated one of the plurality of studs 40 when the first 64 and second 66 movable portions of the primary frame 12 are positioned in the stored position. The plurality of studs 40 selectively couples the carrying frame 57 to the primary frame 12.

A lip 97 is coupled to and extends rearwardly away from each of the first 53 and second 55 lateral arms of the carrying frame 57 and each of the top 63 and bottom 65 arms of the carrying frame. The lip 97 is coextensive with the first 53 and second 55 lateral arms and the top 63 and bottom 65 arms of the carrying frame. The first 64 and second 66 movable portions of the primary frame 12 are positioned inside of the lip 97 when the carrying frame 57 is coupled to the primary frame 12. The lip 97 provides additional support so the plurality of studs 40 do not support the entire weight of the primary frame 12.

A plurality of pads 99 is coupled between each of the pair of spaced medial arms 67 of the carrying frame 57. The plurality of pads 99 is evenly distributed between the medial lateral arm of the carrying frame and the bottom end 69 of each of the spaced medial arms 67 of the carrying frame 57. Continuing, a plurality of pin apertures 100 extends through a first lateral side 101 and a second lateral side 102 of each of the pair of spaced medial arms 67. A plurality of pins 103 is each insertable into an associated one of the plurality of pin apertures 100. Further, a pair of shoulder straps 104 are each selectively coupled to an associated pair of the plurality of pins 103. The carrying frame 57 is worn on the user's back when the carrying frame 57 is coupled to the primary frame 12 so the plurality of pads 99 abuts the user's back.

A wheel mount 105 is selectively insertable into the wheel aperture 83. Moreover, a free end 106 of the wheel mount 105 extends downwardly into the wheel arm 75. The wheel mount 105 may have a length between 10 cm and 20 cm. A wheel 107 is rotatably coupled to a coupled end 108 of the wheel mount 105. The wheel 107 is positioned proximate the top arm of 63 the carrying frame 57 when the wheel mount 105 is inserted into the wheel aperture 83. Moreover, the wheel 107 is selectively rolled along the support surface 49 so the assembly 10 is selectively transported along the support surface 49.

In use, each of the first 23 and second 27 secondary frames are removed from the primary frame 12. Continuing, each of the first set of legs 45 are inserted into an associated one of the leg supports 98 on each of the first 23 and second 27 secondary frames. The user sits on a top surface 109 of the panel 94 on each of the first 23 and second 27 secondary frames. Additionally, the first 64 and second 66 movable portions of the primary frame 12 are moved into the extended position. Each of the set of second legs 47 are inserted into an associated one of legs supports 32 on each of the first 64 and second 66 movable portions of the primary frame 12. The objects are placed on the top surface 72, 74, 76 of the panels 28, 60 on each of the first 64 and second 66 movable portion and the central portion 46 of the primary frame 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A backpack assembly for converting into a table and chairs, said assembly comprising:

a primary frame being selectively positionable between a table position and a box position, said primary frame comprising;

a movable portion of said primary frame operationally coupled to a central portion of said primary frame;

a secondary frame operationally coupled to said primary frame, said secondary frame being selectively used as a chair;

a leg being selectively coupled to said primary frame wherein said primary frame is supported above a support surface when said primary frame is selectively positioned into the table position;

a carrying frame being operationally coupled to said primary frame, said carrying frame being selectively coupled to a user wherein the user carries said assembly; and a wheel selectively coupled to said carrying frame wherein said assembly is selectively rolled along the support surface;

a leg support coupled to and extending away from a bottom side of said movable portion of said primary frame; and said leg support being one of a pair of said leg supports each positioned proximate an associated intersection of an exterior arm of said movable portion of said primary frame and a top and bottom arm of said movable portion of said primary frame.

2. The assembly according to claim 1 further comprising said movable portion of said primary frame comprising an exterior arm and an interior arm of said movable portion of said primary frame each coupled between an associated first end and second end of each of a top arm and a bottom arm of said movable portion of said primary frame wherein said movable portion of said primary frame has a rectangular shape.

3. The assembly according to claim 1 further comprising:

a brace extending between at least one said leg support and an exterior arm of said movable portion of said primary frame;

a stud coupled to and extending laterally away from said brace proximate a center of said brace; and said brace being one of a pair of said braces each extending between an associated one of a first one and a second one of said leg supports and an exterior arm of said movable portion of said primary frame.

4. The assembly according to claim 1 further comprising said central portion of said primary frame comprising a first lateral arm and a second lateral arm of said central portion of said primary frame each coupled between an associated first end and second end of each of a top arm and a bottom arm of said central portion of said primary frame wherein said central portion of said primary frame has a rectangular shape.

5. The assembly according to claim 1 further comprising:

a panel coupled to a top side of said movable portion of said primary frame wherein said panel completely covers said top side of said movable portion of said primary frame; and a panel coupled to a top side of said central portion of said primary frame wherein said panel completely covers said top side of said central portion of said primary frame.

6. The assembly according to claim 1 further comprising:

said movable portion of said primary frame being one of a pair of movable portions of said primary frame;

an exterior arm of a first one of said pair of movable portions of said primary frame being coextensively and hingedly coupled to a first lateral arm of said central portion of said primary frame; and an exterior arm of a second one of said pair of movable portions of said primary frame being coextensively and hingedly coupled to a second lateral arm of said central portion of said primary frame.

7. The assembly according to claim 1 further comprising:

each of a first and second movable portions of said primary frame each being positionable in a stored position wherein each of said first and second movable portions of said primary frame extends away from said central portion of said primary frame at a right angle wherein a bottom end of a pair of said leg supports on said first portion of said primary frame abuts a bottom end of an associated one of a pair of said leg supports on said second portion of said primary frame wherein said primary frame forms a rectangular parallelepiped shape wherein said primary frame is configured to contain objects; and said first and second movable portions of said primary frame being each being positionable in an extended position wherein each of said first and second movable portions of said primary frame extends laterally away from said central portion of said primary frame wherein said primary frame forms a table.

8. The assembly according to claim 1 further comprising:

a first lateral arm and a second lateral arm of said secondary frame each coupled between an associated one of a first end and a second end of each of a top arm and a bottom arm of said secondary frame wherein said secondary frame has a rectangular shape; and a central arm of said secondary frame coupled between said top and bottom arms of said secondary frame.

9. The assembly according to claim 1 further comprising:

said plurality of leg supports comprising a pair of sets of leg supports;

a first one of said pair of sets of said leg supports each being coupled to a bottom side of an intersection of a first lateral arm of said secondary frame and an associated one of a top and bottom arm of said secondary frame; and a second one of said pair of sets of said leg supports each being coupled to an inner side of an intersection of a second lateral arm of said secondary frame and an associated one of said top and bottom arms of said secondary frame.

10. The assembly according to claim 1 further comprising a panel coupled to a top side of said secondary frame wherein said panel completely covers said top side of said secondary frame.

11. The assembly according to claim 1 further comprising:

said secondary frame being one of a pair of said secondary frames;

a first one of said pair of secondary frames being removably coupled to a top end of said primary frame when a first and second movable portions of said primary frame are positioned in a stored position wherein said first secondary frame completely covers said top end of said primary frame; and a second one of said pair of secondary frames being removably coupled to a bottom end of said primary frame when said first and second movable portions of said primary frame are positioned in said stored position wherein said second secondary frame completely covers said bottom end of said primary frame.

12. The assembly according to claim 1 further comprising:

a top portion of said leg having a width and a depth being less than a width and a depth of a bottom portion of said leg wherein said top portion of said leg is selectively insertable into an open bottom end of one of said leg supports; and said leg being one of a plurality of said legs.

13. The assembly according to claim 12 further comprising:

said plurality of legs comprising a pair of sets of said plurality of legs;

each of a first one of said pair of sets of said plurality of legs having a length being less than a length of each of a second one of said pair of sets of said plurality of legs;

each of said first set of said plurality of legs being selectively inserted into an associated one of said plurality of leg supports on said primary frame when said first and second movable portions of said primary frame are positioned in a deployed position wherein said first set of said plurality of legs supports said primary frame above the support surface wherein said primary frame is configured to be used as a table; and each of a second set of said plurality of legs being selectively inserted into an associated one of said plurality of leg supports on each of a first and second secondary frame wherein said first and second secondary frames are supported above the support surface wherein said first and second secondary frames are configured to support a user.

14. The assembly according to claim 1 further comprising:

a first lateral arm and a second lateral arm of said carrying frame each being coupled between an associated one of a first end and a second end of each of a top and bottom arm of said carrying frame wherein said carrying frame has a rectangular shape;

a pair of spaced medial arms of said carrying frame being coupled between said top and bottom arms of said carrying frame wherein a bottom end of each of said pair of spaced medial arms extends beyond said bottom arm of said carrying frame;

a medial lateral arm of said carrying frame being coupled between said pair of spaced medial arms of said carrying frame proximate a top end of each of said pair of spaced medial arms of said carrying frame;

a wheel arm coupled between said top arm of said carrying frame and said medial lateral arm of said carrying frame wherein said wheel arm is positioned proximate a middle of said top arm of said carrying frame; and a wheel aperture extending through a top side of said top arm of said carrying frame wherein said wheel aperture is aligned with an interior of said wheel arm.

15. The assembly according to claim 1 further comprising:

a panel coupled to a back side of said carrying frame wherein said panel completely covers said back side of said carrying frame;

a stud aperture extending through a front side and a back side of said panel on said carrying frame;

said stud aperture being one of a plurality of said stud apertures each positioned proximate an associated one of four corners of said panel on said carrying frame;

each of said plurality of stud apertures insertably receiving an associated one of a plurality of studs when a first and second movable portions of said primary frame are positioned in a stored position wherein said carrying frame is selectively coupled to said primary frame; and a plurality of pads coupled between each of a pair of spaced medial arms of said carrying frame wherein said plurality of pads is evenly distributed between a medial lateral arm of said carrying frame and a bottom end of each of said spaced medial arms of said carrying frame.

16. The assembly according to claim 1 further comprising said carrying frame being worn on a user's back when said carrying frame is coupled to said primary frame wherein a plurality of pads abuts the user's back.

17. The assembly according to claim 1 further comprising:

a wheel mount being selectively inserted into a wheel aperture wherein a free end of said wheel mount extends downwardly into a wheel arm;

said wheel being rotatably coupled to a coupled end of said wheel mount wherein said wheel is positioned proximate a top arm of a said carrying frame; and said wheel being selectively rolled along the support surface.

18. A backpack assembly for converting into a table and chairs, said assembly comprising:

a movable portion of a primary frame comprising an exterior arm and an interior arm of said movable portion of said primary frame each coupled between an associated first end and second end of each of a top arm and a bottom arm of said movable portion of said primary frame wherein said movable portion of said primary frame has a rectangular shape;

a panel coupled to a top side of said movable portion of said primary frame wherein said panel completely covers said top side of said movable portion of said primary frame;

a leg support coupled to and extending away from a bottom side of said movable portion of said primary frame, said leg support being one of a pair of said leg supports each positioned proximate an associated intersection of said exterior arm of said movable portion of said primary frame and said top and bottom arms of said movable portion of said primary frame;

a brace extending between said leg support on said movable portion of said primary frame and said exterior arm of said movable portion of said primary frame;

a stud coupled to and extending laterally away from said brace proximate a center of said brace;

said brace being one of a pair of said braces each extending between an associated one of a first one and a second one of said pair of leg supports and an exterior arm of said movable portion of said primary frame;

a central portion of said primary frame comprising a first lateral arm and a second lateral arm of said central portion of said primary frame each coupled between an associated first end and second end of each of a top arm and a bottom arm of said central portion of said primary frame wherein said central portion of said primary frame has a rectangular shape;

a panel coupled to a top side of said central portion of said primary frame wherein said panel completely covers said top side of said central portion of said primary frame;

said movable portion of said primary frame being one of a pair of movable portions of said primary frame;

an exterior arm of a first one of said pair of movable portions of said primary frame being coextensively and hingedly coupled to said first lateral arm of said central portion of said primary frame;

an exterior arm of a second one of said pair of movable portions of said primary frame being coextensively and hingedly coupled to said second lateral arm of said central portion of said primary frame;

each of said first and second movable portions of said primary frame being positionable in a stored position wherein each of said first and second movable portions of said primary frame extends away from said central portion of said primary frame at a right angle wherein a bottom end of said pair of leg supports on said first portion of said primary frame abuts a bottom end of an associated one of a pair of leg supports on said second portion of said primary frame wherein said primary frame forms a rectangular parallelepiped shape wherein said primary frame is configured to contain objects;

said first and second movable portions of said primary frame being each being positionable in an extended position wherein each of said first and second movable portions of said primary frame extends laterally away from said central portion of said primary frame wherein said primary frame forms a table;

a first lateral arm and a second lateral arm of a secondary frame each coupled between an associated one of a first end and a second end of each of a top arm and a bottom arm of said secondary frame wherein said secondary frame has a rectangular shape;

a central arm of said secondary frame coupled between said top and bottom arms of said secondary frame;

a panel coupled to a top side of said secondary frame wherein said panel completely covers said top side of said secondary frame;

a leg support coupled to a bottom side of said secondary frame, said leg support being one of a plurality of leg supports;

said plurality of leg supports comprising a pair of sets of leg supports;

a first one of said pair of sets of said leg supports each being coupled to a bottom side of an intersection of said first lateral arm of said secondary frame and an associated one of said top and bottom arm of said secondary frame;

a second one of said pair of sets of said leg supports each being coupled to an inner side of an intersection of said second lateral arm of said secondary frame and an associated one of said top and bottom arms of said secondary frame;

said secondary frame being one of a pair of said secondary frames;

a first one of said pair of secondary frames being removably coupled to a top end of said primary frame when said first and second movable portions of said primary frame are positioned in a stored position wherein said first secondary frame completely covers said top end of said primary frame;

a second one of said pair of secondary frames being removably coupled to a bottom end of said primary frame when said first and second movable portions of said primary frame are positioned in said stored position wherein said second secondary frame completely covers said bottom end of said primary frame;

a leg being selectively coupled to said primary frame, a top portion of said leg having a width and a depth being less than a width and a depth of a bottom portion of said leg wherein said top portion of said leg is selectively insertable into an open bottom end of said leg support on said secondary frame; and said leg being one of a plurality of said legs, said plurality of legs comprising a pair of sets of said plurality of legs;

each of a first one of said pair of sets of said plurality of legs having a length being less than a length of each of a second one of said pair of sets of said plurality of legs;

each of said first set of said plurality of legs being selectively inserted into said plurality of leg supports on said primary frame when said first and second movable portions of said primary frame are positioned in said deployed position wherein said first set of said plurality of legs supports said primary frame above the support surface wherein said primary frame is configured to be used as a table;

each of a second set of said plurality of legs being selectively inserted into said plurality of leg supports on each of said first and second secondary frames wherein said first and second secondary frames are supported above the support surface wherein said first and second secondary frames are configured to support a user;

a first lateral arm and a second lateral arm of a carrying frame each being coupled between an associated one of a first end and a second end of each of a top and bottom arm of said carrying frame wherein said carrying frame has a rectangular shape;

a pair of spaced medial arms of said carrying frame being coupled between said top and bottom arms of said carrying frame wherein a bottom end of each of said pair of spaced medial arms extends beyond said bottom arm of said carrying frame;

a medial lateral arm of said carrying frame being coupled between said pair of spaced medial arms of said carrying frame proximate a top end of each of said pair of spaced medial arms of said carrying frame;

a wheel arm coupled between said top arm of said carrying frame and said medial lateral arm of said carrying frame wherein said wheel arm is positioned proximate a middle of said top arm of said carrying frame;

a wheel aperture extending through a top side of said top arm of said carrying frame wherein said wheel aperture is aligned with an interior of said wheel arm;

a panel coupled to a back side of said carrying frame wherein said panel completely covers said back side of said carrying frame;

a stud aperture extending through a front side and a back side of said panel on said carrying frame, said stud aperture being one of a plurality of said stud apertures each positioned proximate an associated one of four corners of said panel on said carrying frame, each of said plurality of stud apertures insertably receiving an associated one of said plurality of studs when said first and second movable portions of said primary frame are positioned in said stored position wherein said carrying frame is selectively coupled to said primary frame; and a plurality of pads coupled between each of a pair of spaced medial arms of said carrying frame wherein said plurality of pads is evenly distributed between a medial lateral arm of said carrying frame and a bottom end of each of said spaced medial arms of said carrying frame;

said carrying frame being worn on the user's back when said carrying frame is coupled to said primary frame wherein said plurality of pads abuts the user's back;

a wheel mount being selectively inserted into said wheel aperture wherein a free end of said wheel mount extends downwardly into a wheel arm; and a wheel being rotatably coupled to a coupled end of said wheel mount wherein said wheel is positioned proximate said top arm of a said carrying frame when said wheel mount is inserted into said wheel aperture said wheel being selectively rolled along the support surface wherein said assembly is selectively rolled along the support surface.

* * * * *